US011492808B2

(12) United States Patent
Shaw

(10) Patent No.: US 11,492,808 B2
(45) Date of Patent: Nov. 8, 2022

(54) ADJUSTABLE LOCK FOR BUILDING SURFACE PANEL AND BUILDING SURFACE PANEL CLADDING SYSTEM

(71) Applicant: CertainTeed LLC, Malvern, PA (US)

(72) Inventor: Robert D. Shaw, Parma, MI (US)

(73) Assignee: CertainTeed LLC, Malvern, PA (US)

( * ) Notice: Subject to any disclaimer, the term of this patent is extended or adjusted under 35 U.S.C. 154(b) by 0 days.

(21) Appl. No.: 17/062,967

(22) Filed: Oct. 5, 2020

(65) Prior Publication Data

US 2021/0102382 A1 Apr. 8, 2021

Related U.S. Application Data

(60) Provisional application No. 62/910,967, filed on Oct. 4, 2019.

(51) Int. Cl.
*E04F 13/08* (2006.01)

(52) U.S. Cl.
CPC ..... *E04F 13/0894* (2013.01)

(58) Field of Classification Search
CPC ..... E04F 13/0894; E04F 13/0848; E04F 13/0876; E04F 13/18; E04F 13/12
See application file for complete search history.

(56) References Cited

U.S. PATENT DOCUMENTS 2,642,968 A * 6/1953 Roush ..... E04F 13/0864 52/522
3,593,479 A * 7/1971 Hinds ..... B44F 9/02 D25/139
3,603,057 A * 9/1971 Curran ..... E04F 13/12 52/529
4,063,393 A * 12/1977 Toti ..... E04F 13/12 52/762
4,122,643 A * 10/1978 Hafner ..... E04F 13/0864 52/529
5,074,093 A * 12/1991 Meadows ..... E04D 3/32 52/537
5,661,939 A * 9/1997 Coulis ..... B29C 48/304 52/745.19
6,122,877 A * 9/2000 Hendrickson ..... E04F 13/0864 52/592.1
6,971,211 B1 * 12/2005 Zehner ..... E04F 13/0864 521/143

(Continued)

*Primary Examiner* — Brian E Glessner
*Assistant Examiner* — Adam G Barlow
(74) *Attorney, Agent, or Firm* — McDonnell Boehnen Hulbert & Berghoff LLP

(57) ABSTRACT

The present disclosure relates generally to building surface panels, for example, polymer siding suitable for covering the exterior surface of a building. The present disclosure relates more particularly to a building surface panel including an elongate panel body having a length, a width, a front face, a rear face, a first edge, a second edge, a first end, and a second end. A lock is disposed at the second edge of the panel body and a catch disposed at the first edge of the panel body. The catch is configured to receive a corresponding lock of a neighboring building surface panel having a similar construction, where the catch includes a plurality of recesses. Each recess is configured to hold the corresponding lock in a respective position such that the catch is configured to secure the lock in any of a plurality of selectable positions.

19 Claims, 4 Drawing Sheets

(56) References Cited

U.S. PATENT DOCUMENTS 6,979,189 B2 12/2005 Baxter
7,204,062 B2 * 4/2007 Fairbanks ..... E04F 13/0864 52/522
7,520,099 B2 * 4/2009 Pringle ..... E04F 13/0864 52/302.1
7,685,787 B1 * 3/2010 Mollinger ..... E04F 21/1855 52/459
7,698,865 B2 * 4/2010 Pringle ..... E04F 13/0864 52/529
7,934,352 B1 * 5/2011 Mollinger ..... E04F 17/00 52/545
7,984,597 B2 * 7/2011 Mollinger ..... B29C 48/908 52/518
8,117,801 B2 * 2/2012 Jambois ..... E04F 13/0864 52/522
8,225,568 B1 * 7/2012 Mollinger ..... E04F 13/0864 52/302.4
8,381,472 B1 * 2/2013 Fleenor ..... E04F 13/0825 52/459
8,590,251 B2 * 11/2013 Bandera ..... E04F 13/0876 52/545
8,795,813 B2 * 8/2014 Olvey ..... E04C 2/296 428/167
9,482,011 B2 11/2016 Steffes
10,550,578 B2 * 2/2020 O'Neal ..... E04F 13/0803
2003/0024187 A1 * 2/2003 Wilt ..... E04D 13/158 52/518
2005/0081468 A1 * 4/2005 Wilson ..... E04F 13/0846 52/528
2016/0340909 A1 * 11/2016 Riebel ..... E04F 13/0894
2018/0058063 A1 * 3/2018 Delfino ..... E04F 13/0894
2018/0187421 A1 * 7/2018 Schultz ..... E04F 13/0864
2019/0301174 A1 10/2019 Schultz
2019/0301175 A1 10/2019 Steffes
2019/0301176 A1 10/2019 Shaw

* cited by examiner

ADJUSTABLE LOCK FOR BUILDING SURFACE PANEL AND BUILDING SURFACE PANEL CLADDING SYSTEM

CROSS-REFERENCE TO RELATED APPLICATIONS

This application claims the benefit of priority of U.S. Provisional Patent Application 62/910,967, filed Oct. 4, 2019, which is hereby incorporated herein by reference in its entirety.

BACKGROUND OF THE DISCLOSURE

1. Field of the Disclosure

The present disclosure relates generally to building surface panels, for example, polymer siding suitable for covering the exterior surface of a building. The present disclosure relates more particularly to building surface panels that connect to one another.

2. Technical Background

Building surface panels, such as cladding or siding, are visible elements that cover an underlying support structure. The panels can provide protection of the support structure and also form the visible facade of the wall or other building surface. Such panels come in a various different shapes to allow for many different aesthetic options. For example, manufactured siding products can have many different profiles including clapboard, dutchlap, beaded, board and batten, shake siding, or shingle siding. The variety of different siding profile options allows architects and builders to choose a particular aesthetic for the building surface. Moreover, covering several sections of a building surface with panels that have different profiles gives the architect or builder even more design options for the building surface aesthetic.

Many building surface panels are configured to be attached directly to the support structure, for example, using mechanical fasteners, adhesive, or another attachment method. In addition, building surface panels often interconnect to one another, which strengthens the structural integrity of the surface and the overall connection of the panels to the support structure. For example, manufactured siding often includes a lock toward the top of the siding and a hook-shaped butt at the bottom. The lock of a lower panel is securely received in the butt at the bottom of an upper panel to create a strong connection between the two adjacent panels. Such a configuration allows a strong interconnection between adjacent panels, but also limits the appearance of the panel surface to a single profile configuration, where the panels consistently overlap in the same manner and form a predetermined repeating pattern.

The present inventors have recognized that building surface panels with a selectable interconnection would be attractive to builders and customers by allowing for more than one installation configuration.

SUMMARY OF THE DISCLOSURE

In one aspect, the present disclosure provides a building surface panel comprising:

an elongate panel body including a length, a width, a front face, a rear face, a first edge, a second edge, a first end, and a second end;

a lock disposed at the second edge of the panel body;

a catch disposed at the first edge of the panel body, the catch being configured to receive a corresponding lock of a neighboring building surface panel having a similar construction, wherein the catch includes a plurality of recesses, wherein each recess is configured to hold the corresponding lock in a respective position such that the catch is configured to secure the lock in any of a plurality of selectable positions.

In another aspect, the disclosure provides a building surface cladding system comprising:

a support structure;

a first building surface panel according to any of claims 1 to 18 attached to the support structure;

a second building surface panel according to any of claims 1 to 18 attached to the support structure, wherein a lock of the first building surface panel is received in a catch of the second building surface panel.

Additional aspects of the disclosure will be evident from the disclosure herein.

BRIEF DESCRIPTION OF THE DRAWINGS

The accompanying drawings are included to provide a further understanding of the methods and devices of the disclosure, and are incorporated in and constitute a part of this specification. The drawings are not necessarily to scale, and sizes of various elements may be distorted for clarity. The drawings illustrate one or more embodiment(s) of the disclosure, and together with the description serve to explain the principles and operation of the disclosure.

DETAILED DESCRIPTION

As described above, the present inventors have noted that conventional building surface panels that interconnect can only be installed in a single configuration. The present inventors have determined that building surface panels that allow for a selectable interconnection would be attractive to builders and customers by allowing for more than one installation configuration.

Accordingly, one aspect of the disclosure is a building surface panel including an elongate panel body. The panel body includes a length, a width, a front face, a rear face, a first edge, a second edge, a first end, and a second end. The building surface panel also includes a lock disposed at the second edge of the panel body and a catch disposed at the first edge of the panel body. The catch is configured to receive a corresponding lock of a neighboring building surface panel that has a similar construction. The catch includes a plurality of recesses, where each recess is configured to hold the corresponding lock in a respective position such that the catch is configured to secure the lock in any of a plurality of selectable positions.

Figure 1:
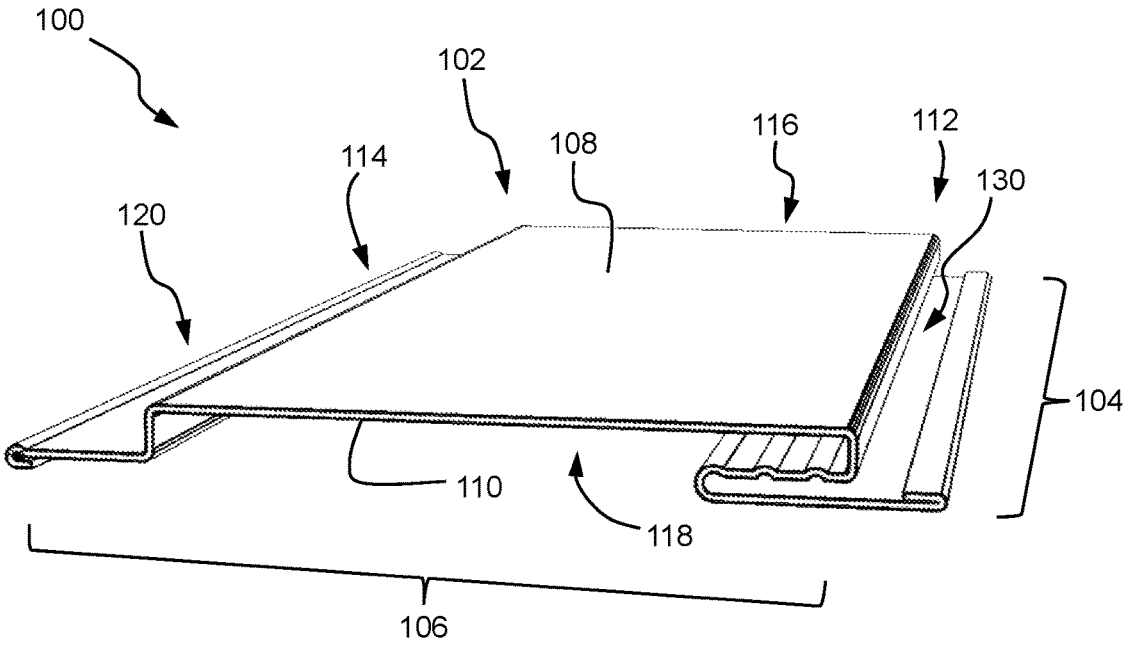
FIG. 1 is a schematic perspective view of a building surface panel according to an embodiment of the disclosure.
Figure 2:
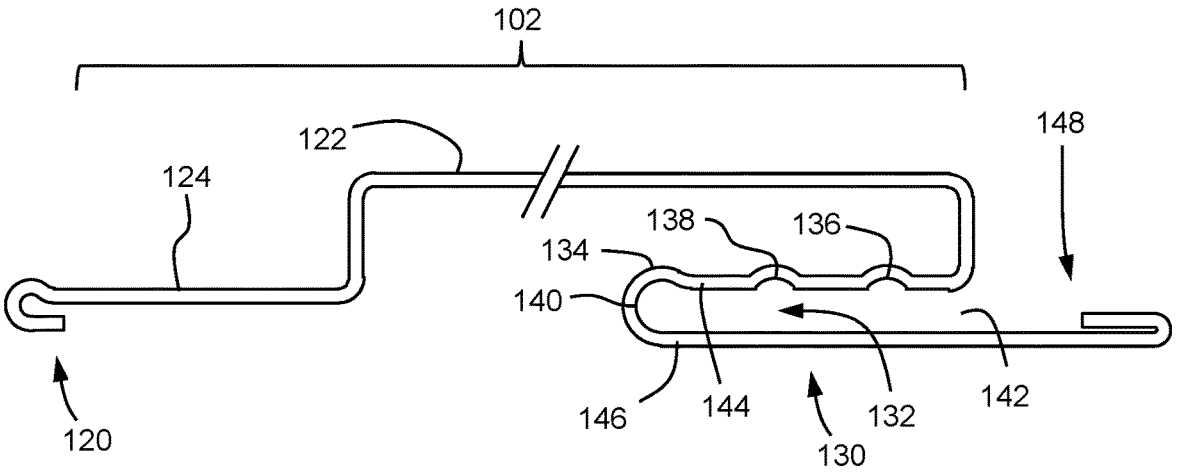
FIG. 2 is a schematic cross-sectional view of the building surface panel of FIG. 1.

Such a building surface panel is shown in perspective view in FIG. 1 and cross-sectional side view in FIG. 2. Building surface panel 100 includes an elongate panel body 102 including a length 104, a width 106, a front face 108, a rear face 110, a first edge 112, a second edge 114, a first end 116, and a second end 118. Length 104 extends from first end 116 to second end 118 and is greater in magnitude than width 106, which extends from first edge 112 to second edge 114. Front face 108 extends across panel body 102 from first edge 112 to second edge 114 and from first end 116 to second end 118. Further, front face 108 is configured to face outwardly and be at least partially exposed when building surface panel 100 is attached to a support structure. Rear face 110 is disposed on the opposite side of panel body 102 from front face 108 and also extends across panel body 102 from first edge 112 to second edge 114 and from first end 116 to second end 118.

Building surface panel 100 also includes a lock 120 disposed at second edge 114 of panel body 102 and a catch 130 disposed at first edge 112 of panel body 102. Lock 120 is configured to be received in a corresponding catch of a neighboring building surface panel having a similar construction. Likewise, catch 130 of building surface panel 100 is configured to receive a corresponding lock of another neighboring building surface panel that has a similar construction. Specifically, catch 130 includes a plurality of recesses 134, 136, 138, which are configured to selectively hold the lock of another building surface panel. Accordingly, catch 130 is able to secure the lock of the neighboring building surface panel in a plurality of selectable positions that correspond to the plurality of recesses.

Figure 3:
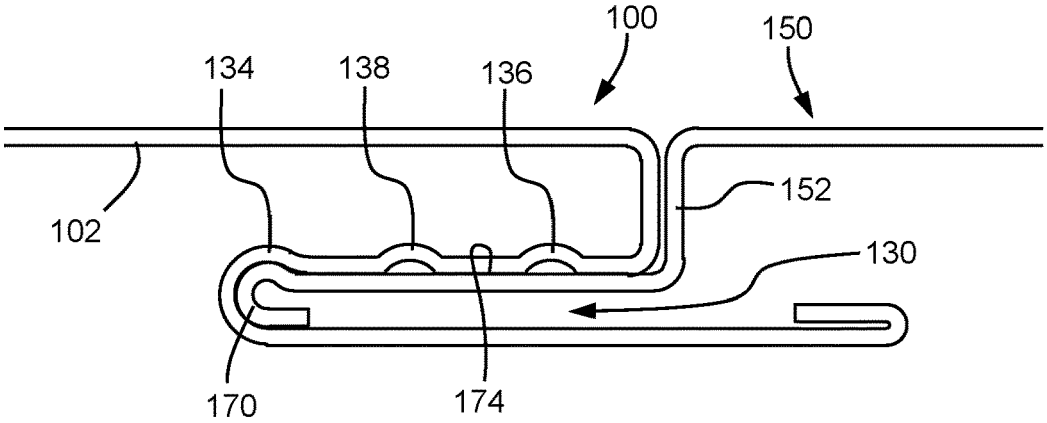
FIG. 3 is a schematic cross-sectional view of the building surface panel of FIG. 1 connected to another building surface panel in a first configuration.
Figure 4:
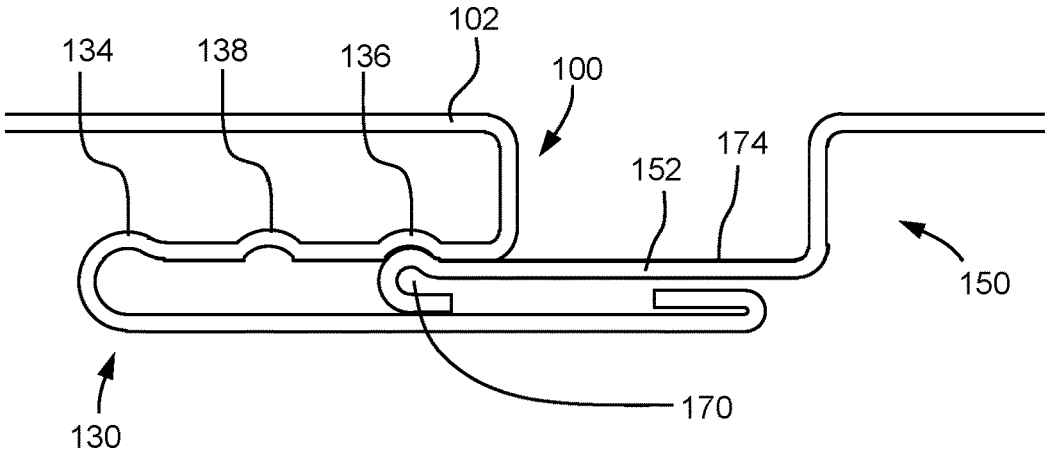
FIG. 4 is a schematic cross-sectional view of the building surface panels of FIG. 3 connected to one another in a second configuration.
Figure 5:
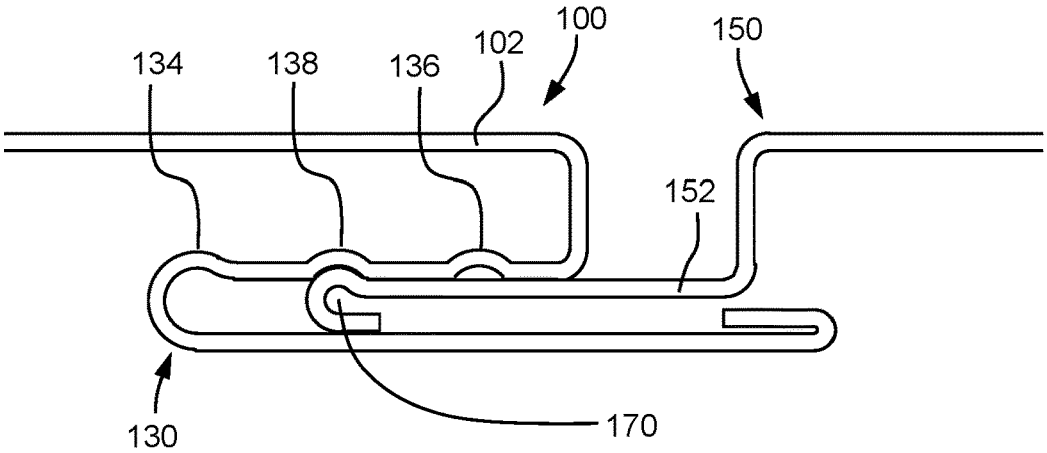
FIG. 5 is a schematic cross-sectional view of the building surface panels of FIG. 3 connected to one another in a third configuration.

FIGS. 3-5 illustrate catch 130 of building surface panel 100 receiving a lock 170 of another building surface panel 150 that has a similar configuration to building surface panel 100. FIG. 3 shows lock 170 of building surface panel 150 held in first recess 134 of catch 130, such that there is a substantial overlap between panel body 102 of first building surface panel 100 and panel body 152 of second building surface panel 150. In contrast, FIG. 4 shows lock 170 of building surface panel 150 held in second recess 136, such that there is very a small overlap between panel body 102 of first building surface panel 100 and panel body 152 of second building surface panel 150. Finally, FIG. 5 shows lock 170 of building surface panel 150 held in an intermediate recess 138, which forms an intermediate amount of overlap between panel body 102 of first building surface panel 100 and panel body 152 of second building surface panel 150. Thus, as illustrated, the selected connection between lock 170 and any of recesses 134, 136 and 138 allows for a selectable amount of overlap between the panel bodies 102 and 152 of the building surface panels. Accordingly, a row of building surface panel with a relatively smaller or relatively larger exposed width depending on which recess is selected for connection with the neighboring lock.

In certain embodiments of the building surface panel as otherwise described herein, the building surface panel is a siding product configured to cover an exterior surface of a building wall. In other embodiments, the building surface panel is an interior wall panel. Still in other embodiments, the building surface panel is a flooring product or a roofing product. As will be understood by those of ordinary skill in the art, the building surface panel may be formed as other types of panel products.

In certain embodiments of the building surface panel as otherwise described herein, a surface of the panel body includes a textured contour. For example, in some embodiments, the front face of the panel body has a surface texture having a contour that imitates wood grain. In other embodiments, the front face of the panel body has a surface texture with a contour that imitates a masonry product, such as stone or brick. Still in other embodiments, the front face of the panel body has a surface texture that enhances acoustic performance of the building surface panel. In other embodiments, the front face of the panel body has a contour in a geometric patter. Further, in other embodiments, the front face of the panel body is smooth.

In certain embodiments of the building surface panel as otherwise described herein, the catch includes a channel that extends along the length of the panel body. For example, catch 130 of building surface panel 100 includes a channel 132 that extends from the first end 116 of building surface panel 100 to the second end 118. As shown in FIG. 2, channel 132 includes a closed end 140 and an open 142 that provides access to the channel for inserting the lock of a neighboring building surface panel. Further, channel 132 is defined by a front wall 144 and a rear wall 146 that meet at the closed end 140. In the embodiment of building surface panel 100, the recesses 134, 136, 138 of catch 130 are formed in the front wall 144 of channel 132 and an inserted lock is held in place between the rear wall 146 and one of the recesses 134, 136, 138 formed in the front wall 144. In other embodiments, the recesses are formed in the rear wall of the channel or are formed in both the front wall and the rear wall. Still, in other embodiments, the catch of the building surface panel does not include a channel, and the recesses of the catch are provided along an exposed surface. In such an embodiment, each recess may be configured to individually surround a lock so as to secure the lock without the use of an opposing wall.

In certain embodiments of the building surface panel as otherwise described herein, the channel has a depth in a range from 1 inch to 5 inches, e.g., 2 inches to 3 inches. In some embodiments, the depth of the channel impacts the connection strength between the lock and the catch. For example, a lock that is disposed further into the depth of the channel forms a more secure connection between the adjacent panels than a lock that is disposed immediately adjacent to the open end of the channel.

The depth of the channel also determines the amount of adjustment that is possible between the engagement of the lock and the catch. For example, in certain embodiments of the building surface panel as otherwise described herein, each of the recesses is disposed at a different depth in the channel. For instance, in catch 130, the first recess 134 is disposed at the closed end 140 of channel 132, while the second recess 136 is disposed near the open end 142 of channel 132. Accordingly, a channel having a greater depth allows a larger range in the amount of overlap between neighboring building surface panels. For instance, if a channel has a 4% depth with a first recess disposed at the closed end of the channel and a second recess disposed % inch from the open end of the channel, the overlap between adjacent building surface panels can vary by 4 inches depending on which recess is used to secure the lock. In contrast, if a channel has a 2% depth with a first recess disposed at the closed end of the channel and a second recess disposed % inch from the open end of the channel, the overlap between adjacent building surface panels can vary by only 2 inches. Thus a deeper channel allows for more adjustment in the overlap between building surface panels. On the other hand, with some design configurations a greater channel depth can make installation of the building surface panels on a support structure more difficult.

In certain embodiments of the building surface panel as otherwise described herein, the plurality of recesses includes a first recess and a second recess. For example, catch 130 of building surface panel 100 includes a first recess 134 disposed at the deepest position within channel 132 and a second recess 136 disposed at the shallowest position within channel 132.

In certain embodiments of the building surface panel as otherwise described herein, a distance between the first recess and the second recess is in a range from 1 inch to 5 inches. As explained above, where the first recess and second recess are disposed at a distance of 1 inch from one another, the overlap of neighboring building surface panels can vary up to one inch. Further, where the first recess and second recess are disposed at a distance of 5 inches from one another, the overlap of neighboring building surface panels can vary by up to 5 inches.

In certain embodiments of the building surface panel as otherwise described herein, the plurality of recesses includes at least one intermediate recess between the first recess and the second recess. For example, in addition to first recess 134 and second recess 136, catch 130 also includes a third recess 138 positioned between recesses 134 and 136. The additional recess allows another extent of overlap between adjacent building surface panels to be selected. In other embodiments, the catch only includes two recesses. Further, in still other embodiments, the catch includes more than three recesses, for example, four to ten recesses.

In certain embodiments of the building surface panel as otherwise described herein, each of the recesses is formed as a groove that extends along the length of the panel body. For example, first recess 134, second recess 136, and third recess 138 are each formed as a groove that extends from the first end of the building surface panel to the second end of the building surface panel. In other embodiments, the recess is formed as a groove that extends over a portion of the length of the building surface panel. Still, in other embodiments, the recess is formed as one or more indentations that are configured to receive a lock in the form of one or more corresponding protruding elements.

In certain embodiments of the building surface panel as otherwise described herein, the lock includes a bulbous tip extending from the second edge of the panel body. For example, lock 120 is in the form of a bulbous tip resulting from an edge of the building surface panel that is folded over in a rounded configuration. In particular, lock 120 extends along the length of building surface panel 100 and protrudes from second edge 114 of panel body 102 as an elongate folded element.

In certain embodiments of the building surface panel as otherwise described herein, the building surface panel further includes a fastening strip extending along the length of the panel body and disposed adjacent to the first edge. For example, as shown in FIG. 2, building surface panel 100 includes a fastening strip 148 disposed adjacent to first edge 112 of panel body 102. The fastening strip 148 extends along the entire length of building surface panel 100 and is configured for attaching building surface panel 100 to a support structure. For example, building surface panel 100 may be secured to a support structure using mechanical fasteners that project through fastening strip 148. In some embodiments, the fastening strip includes apertures for receiving mechanical fasteners. In other embodiments the fastening strip is free of any apertures and intended to have mechanical fasteners pass through the fastening strip. Still, in other embodiments the fastening strip includes an adhesive for securing the fastening strip to a surface of an underlying support structure. In some embodiments, the fastening strip may include indicia that identifies length along the building surface panel.

In certain embodiments of the building surface panel as otherwise described herein, the fastening strip is coextensive with a rear wall of a channel of the catch. For example, fastening strip 148 of building surface panel 100 is coextensive with rear wall 146 of channel 132 of catch 130, such that rear wall 146 and fastening strip 148 are in the same plane and there is a smooth transition from the rear wall 146 to the fastening strip 148.

In certain embodiments of the building surface panel as otherwise described herein, the panel body includes a forward planar section and a rearward planar section, and an exposed portion of the rearward planar section is adjustable based on a position of the lock in a corresponding catch of a neighboring building surface panel having a similar construction. For example, panel body 102 of building surface panel 100 includes a forward planar section 122 and a rearward planar section 124. Depending on position of lock 120 in catch 130, more or less of rearward planar section 124 is exposed. For example, in the configuration shown in FIG. 3, where lock 170 of second building surface panel 150 is held in first recess 134 of first building surface panel 100, rearward section 174 of panel body 152 is entirely hidden within the channel 132 of catch 130. On the other hand, in the configuration shown in FIG. 4, where lock 170 is held in the second recess 136 of first building surface panel 100, rearward section 174 of panel body 152 is almost entirely exposed on the front side of the building surface panels.

In certain embodiments of the building surface panel as otherwise described herein, the first edge of the panel body is disposed along the forward planar section and the second edge of the panel body is disposed along the rearward planar section. For example, first edge 112 of panel body 102 in building surface panel 100 is located along the forward planar section 122 where panel body 102 transitions to catch 130. Likewise, second edge 114 of panel body 102 is located along the rearward planar section 124 where panel body 102 transitions to lock 120.

In certain embodiments of the building surface panel as otherwise described herein, the building surface panel has a board and batten configuration. The phrase board and batten configuration, as used herein, applies to any panel configuration that results in rows of offset planar sections that resemble combinations of planks and/or thin strips of material, such as wood. For example, the phrase board and batten includes traditional board and batten where the siding appears as wide boards, where the edges of the boards are covered with thin strips of material, i.e., battens. The phrase board and batten is used herein to also include reverse board and batten, where the edges of thin strips are covered by forward positioned boards. Further, the phrase board and batten is used herein to also include configurations that may be identified as board and board, where forward positioned boards cover the edges of rearward positioned boards.

Embodiments of the building surface panel may be formed from various different materials, and may be constructed in a single piece or in layers of material. In certain embodiments of the building surface panel as otherwise disclosed herein, the material of the panel may comprise any known siding material, such as PVC, polymer, polypropylene, acrylic, Acrylonitrile Styrene Acrylate (ASA), fiberglass, aluminum, steel, any other plastic, wood, or metal, or combinations thereof.

As will be appreciated by those of ordinary skill in the art, the building surface panel can be manufactured using any of various different methods. For example, in some embodiments the building surface panel is extruded. In other embodiments the building surface panel is molded. Further, in some embodiments, t building surface panel is manufactured by a post-formed extrusion method. For example, a flat sheet of material may be heated and extruded through a series of dies. The overall shape of the panel body, as well as the features of the lock and catch, is formed as the sheet moves through the dies. Once the desired shape is created, the panel body is flash cured to retain the shape.

Figure 6:
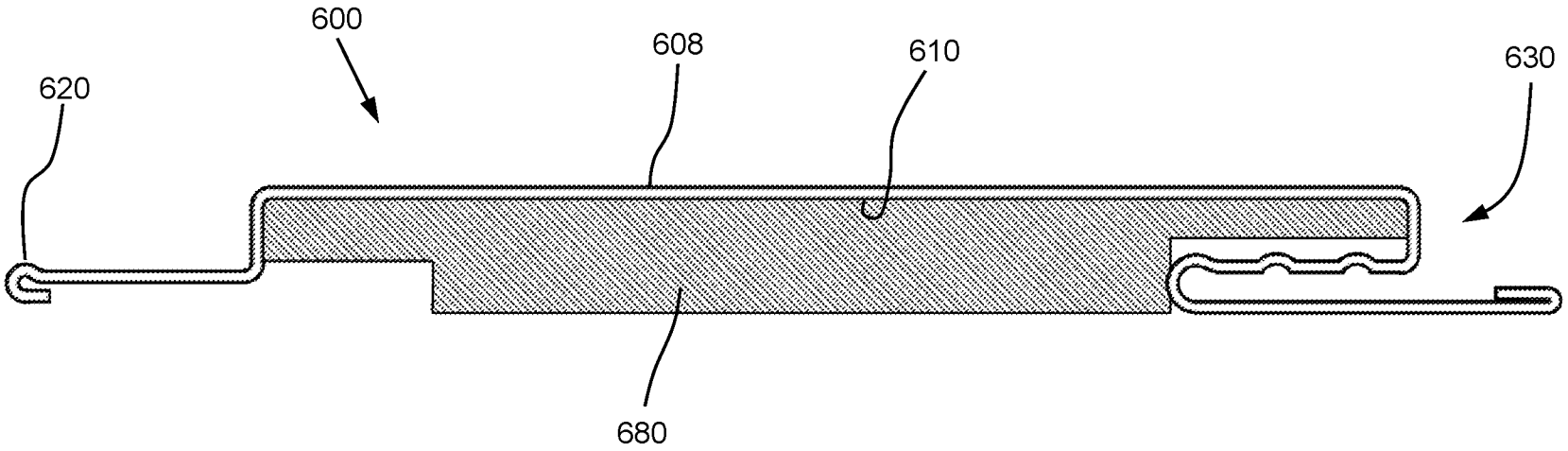
FIG. 6 is a schematic cross-sectional view of a building surface panel according to another embodiment of the disclosure.

In certain embodiments of the building surface panel as otherwise described herein, the building surface panel further includes insulation disposed on the rear face of the panel body. Such a building surface panel is shown in FIG. 6. Building surface panel 600 includes a panel body 602 including a front face 608 and a rear face 610. Building surface panel also includes a lock 620 disposed at one edge of the panel body 602 and a catch 630 disposed at another edge of panel body 602 that is configured to receive a corresponding lock of another building surface panel in various configurations. Further, building surface panel 600 also includes insulation 680 disposed on the rear face 608 of panel body 602. The insulation 680 reduces the thermal conductivity of building surface panel 600 so as to form an insulating panel. As will be understood by those of ordinary skill in the art, the insulation can have various different forms, such as foam insulation.

In certain embodiments of the building surface panel as otherwise described herein, the length of the panel body is in a range from 4 feet to 30 feet, e.g., 6 feet to 24 feet, e.g., 8 feet to 20 feet. Likewise, in some embodiments, the width of the panel body is in a range from 3 inches to 24 inches, e.g., from 4 inches to 18 inches, e.g., from 8 inches to 14 inches. Other lengths and widths are also possible.

In certain embodiments of the building surface panel as otherwise described herein, the panel body has a material thickness in a range from 0.03 inches to 0.20 inches. For example, in some embodiments, the panel body is formed as a thin wall that is molded or extruded. Further, in some embodiments, the lock and the catch extend from the edges of the panel body as an extension of the thin wall. For example, in some embodiments, the panel body, lock, and catch are integrally formed in a single piece. Accordingly, the panel body, lock, and catch can be extruded or molded together in a single operation.

In another aspect, the disclosure provides a building surface cladding system. The building surface cladding system includes a support structure, a first building surface panel according to the disclosure that is attached to the support structure, and a second building surface panel according to the disclosure that is also attached to the support structure. The first and second building surface panels are connected such that a lock of the first building surface panel is received in a catch of the second building surface panel.

Figure 7:
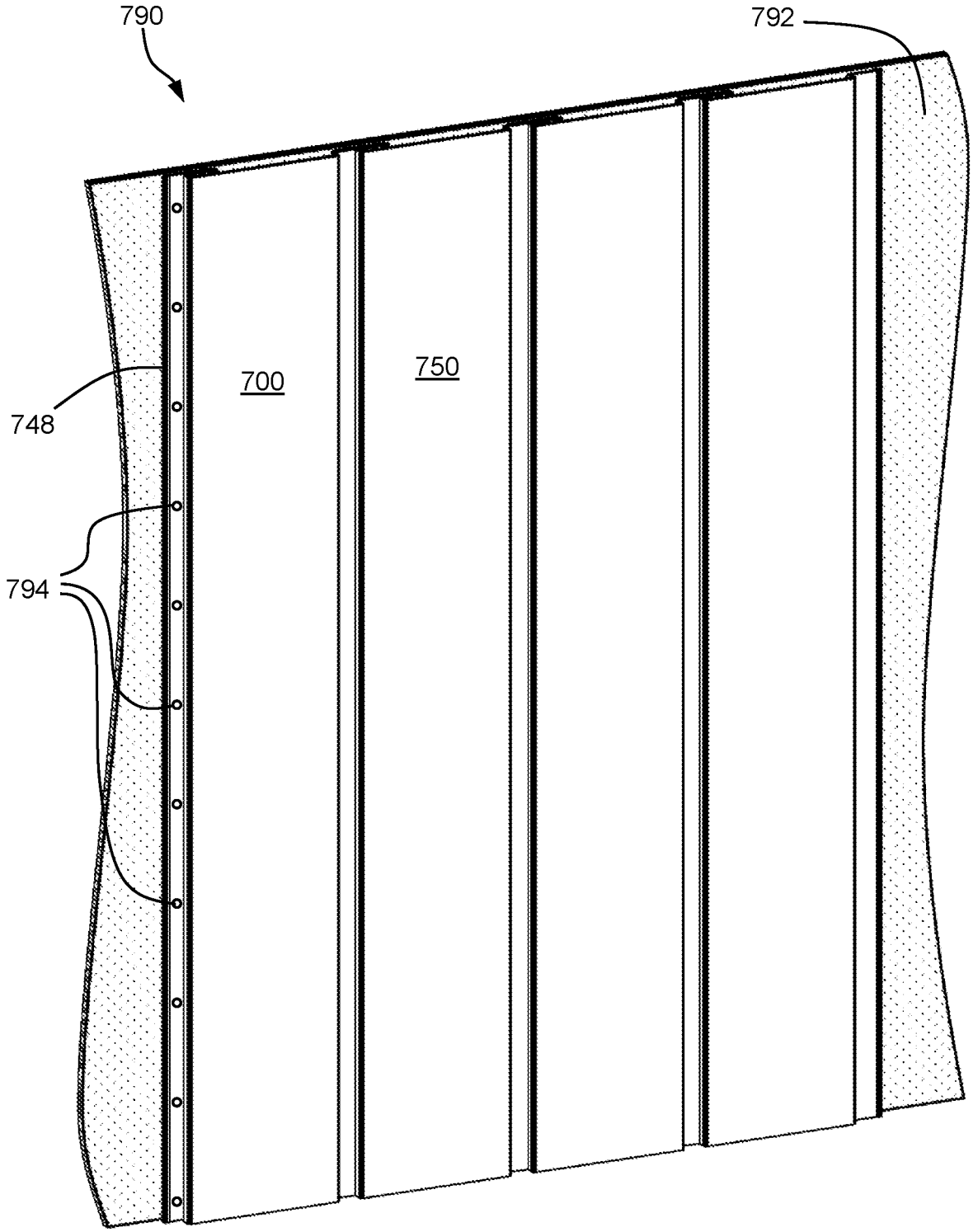
FIG. 7 is a schematic perspective view of a building surface cladding system according to an embodiment of the disclosure.

Such a building surface cladding system is shown in FIG. 7. Building surface cladding system 790 includes a support structure 792 and a number of building surface panels attached to the support structure including a first building surface panel 700 and a second building surface panel 750. Further, a lock of the first building surface panel 700 is received in a catch of the second building surface panel 750.

In certain embodiments of the building surface cladding system as otherwise described herein, the first building surface panel and the second building surface panel have a similar construction. For example, in some embodiments, the first building surface panel and the second building surface panel have the same cross-sectional side profile. In some embodiments, a textured surface of the panel body of the first building surface panel is different from a textured surface of the panel body of the second building surface panel. For instance, the textured surfaces of the different surface panels may appear as different planks of wood. In other embodiments the construction of the first building surface panel and the second building surface panel is identical and differs only in manufacturing tolerances.

In certain embodiments of the as otherwise described herein, the building surface cladding system forms an exterior wall surface. For example, building surface cladding system 790 is formed as a board and batten siding system on a support structure 792 in the form of a wall support. In other embodiments, the building surface cladding system forms a floor surface, or a roof.

In certain embodiments as otherwise described herein, the support structure is an exterior sheathing. For example, support structure 792 of building surface cladding system 790 is configured as an exterior sheathing, for example of a house.

In certain embodiments as otherwise described herein, the lock of the first building surface panel is held in a first recess of the catch of the second building surface panel. For example, in some embodiments, the building surface panels of the building surface cladding system are interconnected in a configuration similar to that shown in FIG. 3, where the lock 170 of one building surface panel is held in the first recess of the catch of a neighboring building surface panel.

In certain embodiments as otherwise described herein, the panel body of each of the first building surface panel and the second building surface panel includes a forward planar section and a rearward planar section, and the rearward planar section of the first building surface panel is positioned behind the forward planar section of the second building surface panel and obscured from view. For example, in a building surface cladding system in which the neighboring building surface panels are interconnected in a manner similar to that shown in FIG. 3, the rearward planar section of each panel body is disposed within the channel of a respective catch, such that the rearward planar section is behind the forward planar section of a neighboring building surface panel and is thereby obscured from view.

In certain embodiments as otherwise described herein, the lock of the first building surface panel is held in a second recess of the catch of the second building surface panel. For example, in some embodiments, the building surface panels of the building surface cladding system are interconnected in a configuration similar to that shown in FIG. 4, where the lock 170 of one building surface panel is held in the second recess of the catch of a neighboring building surface panel.

In certain embodiments as otherwise described herein, the panel body of each of the first building surface panel and the second building surface panel includes a forward planar section and a rearward planar section, and the rearward planar section of the first building surface panel is positioned adjacent to the forward planar section of the second building surface panel and is exposed. For example, in a building surface cladding system in which the neighboring building surface panels are interconnected in a manner similar to that shown in FIG. 4, the rearward planar section of each panel body is exposed in a space between two forward planar sections. For example, the exposed rearward planar sections are shown between forward planar sections in the configuration illustrated in FIG. 7.

In certain embodiments as otherwise described herein, the first building surface panel includes a first fastening strip extending along the respective first edge of the panel body of the first building surface panel, and the second building surface panel includes a second fastening strip extending along the respective first edge of the panel body of the second building surface panel. For example, in building surface cladding system 790, shown in FIG. 7, first building surface panel 700 includes a fastening strip 748 disposed along a first edge of the panel body of first building surface panel 700. Likewise, second building surface panel 750 also includes a fastening strip that is obscured from view by first building surface panel 700.

In certain embodiments as otherwise described herein, the first building surface panel is held to the support surface using mechanical fasteners that extend through the first fastening strip. For example, first building surface panel 700 is held to support structure 792 by mechanical fasteners 794, such as nails, that project through fastening strip 748. In certain embodiments as otherwise described herein, the second building surface panel is held to the support surface using mechanical fasteners that extend through the second fastening strip.

The adjustable interconnection between the building surface panels in the building surface cladding system allows a builder to construct a building surface with various different appearances while only using one type of panel. In addition to allowing the builder to select a certain aesthetic for the installation of the building surface panels, it also allows the builder to construct a wall with sections that have different appearances but use the same type of panel. For example, a wall could be constructed with a first section that has the appearance of board and batten siding and a second section that has the appearance of abutting horizontal panels, despite using only one type of building surface panel.

One of skill in the art will also appreciate that such a system can be installed in a variety of ways. For example, in certain embodiments, the panels are applied horizontally, in a conventional fashion starting at the base of a wall section. In other embodiments, the sections are installed vertically, as shown in FIG. 7, where the installation begins at one side of the wall, and continues to the opposite side. Still, in other embodiments, the panels are arranged to be installed on an angle, this angle being any angle between the horizontal and vertical positions. Such use of an angle for the installation can develop a series of possible aesthetics that could be appealing to an installer or to end customer, as it offers them more choices than a traditional horizontal installation aesthetic.

Additional aspects of the disclosure are provided by the following enumerated embodiments, which may be combined and permuted in any fashion not logically or technically inconsistent Embodiment 1. A building surface panel comprising:

an elongate panel body including a length, a width, a front face, a rear face, a first edge, a second edge, a first end, and a second end;

a lock disposed at the second edge of the panel body;

a catch disposed at the first edge of the panel body, the catch being configured to receive a corresponding lock of a neighboring building surface panel having a similar construction, wherein the catch includes a plurality of recesses, wherein each recess is configured to hold the corresponding lock in a respective position such that the catch is configured to secure the lock in any of a plurality of selectable positions.

Embodiment 2. The building surface panel according to embodiment 1, wherein the catch includes a channel that extends along the length of the panel body.

Embodiment 3. The building surface panel according to embodiment 2, wherein the channel has a depth in a range from 1 inch to 5 inches, e.g., 2 inches to 3 inches.

Embodiment 4. The building surface panel according to embodiment 2 or embodiment 3, wherein each of the recesses is disposed at a different depth in the channel.

Embodiment 5. The building surface panel according to any of embodiments 2 to 4, wherein the plurality of recesses includes a first recess and a second recess.

Embodiment 6. The building surface panel according to embodiment 5, wherein a distance between the first recess and the second recess is in a range from 1 inch to 5 inches.

Embodiment 7. The building surface panel according to embodiment 5 or embodiment 6, wherein the plurality of recesses includes at least one intermediate recess between the first recess and the second recess.

Embodiment 8. The building surface panel according to any of embodiments 1 to 7, wherein each of the recesses is formed as a groove that extends along the length of the panel body.

Embodiment 9. The building surface panel according to any of embodiments 1 to 8, wherein the lock includes a bulbous tip extending from the second edge of the panel body.

Embodiment 10. The building surface panel according to any of embodiments 1 to 9, further comprising a fastening strip extending along the length of the panel body and disposed adjacent to the first edge.

Embodiment 11. The building surface panel according to embodiment 10, wherein the fastening strip is coextensive with a rear wall of a channel of the catch.

Embodiment 12. The building surface panel according to any of embodiments 1 to 11, wherein the panel body includes a forward planar section and a rearward planar section, and wherein an exposed portion of the rearward planar section is adjustable based on a position of the lock in a corresponding catch of a neighboring building surface panel having a similar construction.

Embodiment 13. The building surface panel according to embodiment 12, wherein the first edge of the panel body is disposed along the forward planar section and the second edge of the panel body is disposed along the rearward planar section.

Embodiment 14. The building surface panel according to any of embodiments 1 to 13, wherein the building surface panel has a board and batten configuration.

Embodiment 15. The building surface panel according to any of embodiments 1 to 14, further comprising insulation disposed on the rear face of the panel body.

Embodiment 16. The building surface panel according to any of embodiments 1 to 15, wherein the length of the panel body is in a range from 4 feet to 30 feet, e.g., 6 feet to 24 feet, e.g., 8 feet to 20 feet.

Embodiment 17. The building surface panel according to any of embodiments 1 to 16, wherein the width of the panel body is in a range from 3 inches to 24 inches, e.g., from 4 inches to 18 inches, e.g., from 8 inches to 14 inches.

Embodiment 18. The building surface panel according to any of embodiments 1 to 17, wherein the panel body has a material thickness in a range from 0.03 inches to 0.20 inches.

Embodiment 19. A building surface cladding system comprising:

a support structure;

a first building surface panel according to any of embodiments 1 to 18 attached to the support structure;

a second building surface panel according to any of embodiments 1 to 18 attached to the support structure, wherein a lock of the first building surface panel is received in a catch of the second building surface panel.

Embodiment 20. The building surface cladding system according to embodiment 19, wherein the building surface cladding system forms an exterior wall surface.

Embodiment 21. The building surface cladding system according to embodiment 19 or embodiment 20, wherein the support structure is an exterior sheathing.

Embodiment 22. The building surface cladding system according to any of embodiments 19 to 21, wherein the lock of the first building surface panel is held in a first recess of the catch of the second building surface panel.

Embodiment 23. The building surface cladding system according to embodiment 22, wherein the panel body of each of the first building surface panel and the second building surface panel includes a forward planar section and a rearward planar section, and wherein the rearward planar section of the first building surface panel is positioned behind the forward planar section of the second building surface panel and obscured from view.

Embodiment 24. The building surface cladding system according to any of embodiments 19 to 21, wherein the lock of the first building surface panel is held in a second recess of the catch of the second building surface panel.

Embodiment 25. The building surface cladding system according to embodiment 24, wherein the panel body of each of the first building surface panel and the second building surface panel includes a forward planar section and a rearward planar section, and wherein the rearward planar section of the first building surface panel is positioned adjacent to the forward planar section of the second building surface panel and is exposed.

Embodiment 26. The building surface cladding system according to any of embodiments 19 to 25, wherein the first building surface panel includes a first fastening strip extending along the respective first edge of the panel body of the first building surface panel, and the second building surface panel includes a second fastening strip extending along the respective first edge of the panel body of the second building surface panel.

Embodiment 27. The building surface cladding system according to embodiment 26, wherein the first building surface panel is held to the support surface using mechanical fasteners that extend through the first fastening strip.

Embodiment 28. The building surface cladding system according to embodiment 27, wherein the second building surface panel is held to the support surface using mechanical fasteners that extend through the second fastening strip.

It will be apparent to those skilled in the art that various modifications and variations can be made to the processes and devices described here without departing from the scope of the disclosure. Thus, it is intended that the present disclosure cover such modifications and variations of this invention provided they come within the scope of the appended claims and their equivalents.

What is claimed is:

1. A building surface panel comprising:

an elongate panel body including a length, a width, a front face, a rear face, a first edge, a second edge, a first end, and a second end, the panel body including a forward planar section and a rearward planar section, wherein the rearward planar section extends from the forward planar section to the second edge;

a lock disposed at the second edge of the panel body;

a catch disposed at the first edge of the panel body, the catch being configured to receive a corresponding lock of a neighboring building surface panel, wherein the catch includes a plurality of recesses, wherein each recess is configured to hold the corresponding lock in a respective position such that the catch is configured to secure the lock in any of a plurality of selectable positions; and a fastening strip extending along the length of the panel body and disposed adjacent to the first edge.

2. The building surface panel according to claim 1, wherein the catch includes a channel that extends along the length of the panel body.

3. The building surface panel according to claim 2, wherein the channel has a depth in a range from 1 inch to 5 inches.

4. The building surface panel according to claim 2, wherein each of the recesses is disposed at a different depth in the channel.

5. The building surface panel according to claim 2, wherein the plurality of recesses includes a first recess and a second recess.

6. The building surface panel according to claim 5, wherein a distance between the first recess and the second recess is in a range from 1 inch to 5 inches.

7. The building surface panel according to claim 5, wherein the plurality of recesses includes at least one intermediate recess between the first recess and the second recess.

8. The building surface panel according to claim 1, wherein each of the recesses is formed as a groove that extends along the length of the panel body.

9. The building surface panel according to claim 1, wherein the lock includes a bulbous tip extending from the second edge of the panel body.

10. The building surface panel according to claim 1, wherein an exposed portion of the rearward planar section is adjustable based on a position of the lock in a corresponding catch of a neighboring building surface panel.

11. A building surface cladding system comprising:

a support structure; and a first building surface panel attached to the support structure and a second building surface panel attached to the support structure, each of the first building surface panel and the second building surface panel being a building surface panel comprising:

an elongate panel body including a length, a width, a front face, a rear face, a first edge, a second edge, a first end, and a second end, the panel body including a forward planar section and a rearward planar section, wherein the rearward planar section extends from the forward planar section to the second edge;

a lock disposed at the second edge of the panel body;

a catch disposed at the first edge of the panel body, the catch being configured to receive a corresponding lock of a neighboring building surface panel, wherein the catch includes a plurality of recesses, wherein each recess is configured to hold the corresponding lock in a respective position such that the catch is configured to secure the lock in any of a plurality of selectable positions, wherein a lock of the first building surface panel is received in a catch of the second building surface panel, and wherein the first building surface panel includes a first fastening strip extending along the respective first edge of the panel body of the first building surface panel, and the second building surface panel includes a second fastening strip extending along the respective first edge of the panel body of the second building surface panel.

12. The building surface cladding system according to claim 11, wherein the building surface cladding system forms an exterior wall surface.

13. The building surface cladding system according to claim 11, wherein the lock of the first building surface panel is held in a first recess of the catch of the second building surface panel.

14. The building surface cladding system according to claim 13, wherein the rearward planar section of the first building surface panel is positioned behind the forward planar section of the second building surface panel and obscured from view.

15. The building surface cladding system according to claim 11, wherein the lock of the first building surface panel is held in a second recess of the catch of the second building surface panel.

16. The building surface cladding system according to claim 15, wherein the rearward planar section of the first building surface panel is positioned adjacent to the forward planar section of the second building surface panel and is exposed.

17. The building surface cladding system according to claim 11, wherein the first building surface panel is held to the support surface using mechanical fasteners that extend through the first fastening strip.

18. The building surface panel according to claim 1, wherein each recess is formed as a groove that extends along the length of the panel body.

19. A building surface panel comprising:

an elongate panel body including a length, a width, a front face, a rear face, a first edge, a second edge, a first end, and a second end, the panel body including a forward planar section and a rearward planar section, wherein the rearward planar section extends from the forward planar section to the second edge;

a lock disposed at the second edge of the panel body;

a catch disposed at the first edge of the panel body, the catch being configured to receive a corresponding lock of a neighboring building surface panel, wherein the catch includes a plurality of recesses, wherein each recess is configured to hold the corresponding lock in a respective position such that the catch is configured to secure the lock in any of a plurality of selectable positions, wherein the catch includes a channel that extends along the length of the panel body, and wherein each of the recesses is disposed at a different depth in the channel.

* * * * *